United States Patent [19]

Augspurger et al.

[11] Patent Number: 5,050,865

[45] **Date of Patent: * Sep. 24, 1991**

[54] CYCLE TRAINING DEVICE

[76] Inventors: Quent Augspurger; Charles H. Bartlett, both of 2519 E. Thomas Rd. #A, Phoenix, Ariz. 85016

[ * ] Notice: The portion of the term of this patent subsequent to Apr. 4, 2006 has been disclaimed.

[21] Appl. No.: 319,331

[22] Filed: Mar. 6, 1989

Related U.S. Application Data

[63] Continuation-in-part of Ser. No. 138,152, Dec. 28, 1987, Pat. No. 4,817,939.

[51] Int. Cl.[5] ..... A63B 69/00

[52] U.S. Cl. ..... 272/73; 272/129

[58] Field of Search ..... 272/73, 129, 126, 130, 272/DIG. 5, DIG. 6; 310/36, 76; 211/17, 20–24

[56] References Cited

U.S. PATENT DOCUMENTS

| | | | |
|---|---|---|---|
| 4,084,810 | 4/1978 | Forsman | 272/73 |
| 4,552,356 | 11/1985 | Brousseau | 272/126 |
| 4,602,373 | 7/1986 | Dorfman | 272/73 |
| 4,709,917 | 12/1987 | Yang | 272/73 |
| 4,743,012 | 5/1988 | Kim | 272/73 |
| 4,817,939 | 4/1989 | Augspurger et al. | 272/129 |

*Primary Examiner*—Stephen R. Crow

*Attorney, Agent, or Firm*—Gregory J. Nelson

[57] ABSTRACT

An exercise device having a stand adapted to support a bicycle. The stand has a wheel support which permits side-to-side pivotal motion of the support and bicycles. A roller engages the rear wheel of the bicycle and is in driving relationship through a clutch with the input shaft of an AC induction device connected to a power indicating device. The indication device operates to generate electricity when a predetermined pedal speed is achieved. In another embodiment the exercise device is a dedicated stationary device in which motion may be imparted to the input shaft by pedal crank operation and by manually pivotable handle bars.

12 Claims, 5 Drawing Sheets

FIG. 12
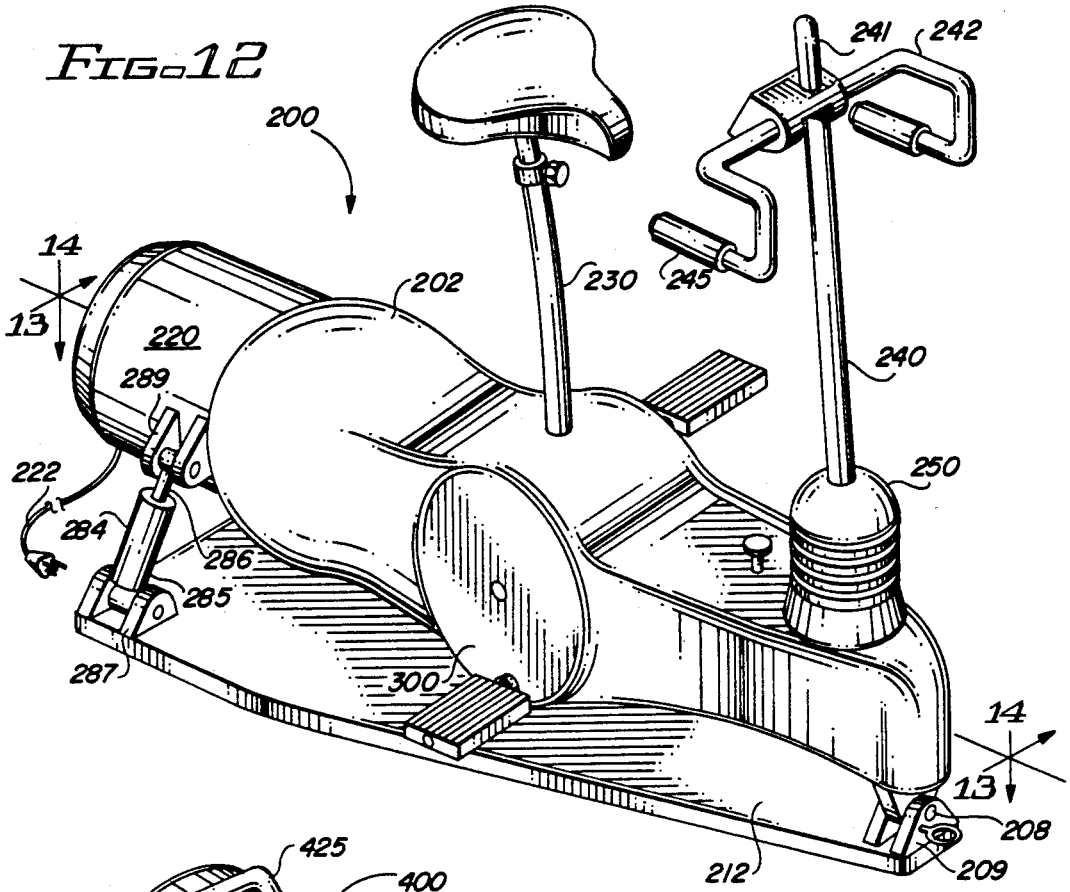
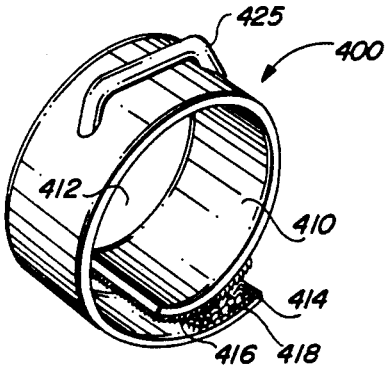
FIG. 19
FIG. 13
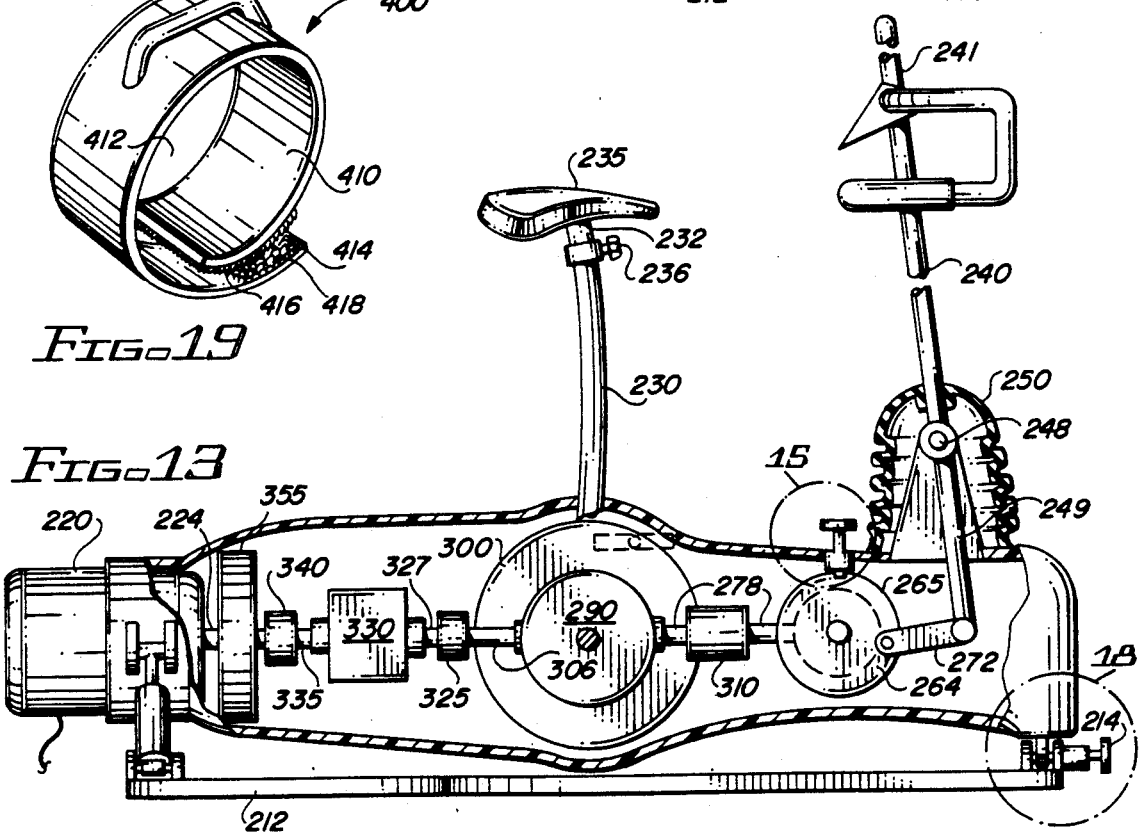

CYCLE TRAINING DEVICE

This is a continuation-in-part of our prior filed application Ser. No. 07/138,152, filed Dec. 28, 1987, entitled "Cycle Training Device", now U.S. Pat. No. 4,817,939.

The present invention relates to a physical training device and more particularly relates to a stationary exercising device adapted to support a conventional bicycle so that the bicycle may be operated as a stationary exercise machine.

It is well documented in the literature that bicycling is one of the most beneficial forms of exercise in that it is aerobic causing the individual to sustain an elevated pulse beat without the detrimental impact which is attendant to other forms of exercise such as running or jogging. Bicycling is also popular since it is an activity which can be performed by individuals of all ages. However, there are situations when time constraints, weather or other conditions do not permit the rider to engage in bicycling out-of-doors on a road or street. In this situation, many riders have training stands which support the bicycle in a stationary position which allow the bicyclist to achieve the benefits of exercise while indoors. Generally these stands support the bicycle in a stationary position with the rear wheel engaging some type of resistance device to enhance the exercise effect. For example, it is common that the rear wheel engage and drive a roller which, in turn, drives a fan or impeller which provides increased resistance as pedal speed increases.

When an individual is engaged in exercise on a stationary bicycle, it is desirable that the bicycle rider have some indication of the amount of energy expended as an indication of the level of exercise. There are various devices in the prior art which are adapted for use with a stationary bicycle apparatus and which provide the rider some indication of the exercise benefit achieved so that the rider may measure the exercise and may also use the stationary bike as a physical training device.

For example, U.S. Pat. No. 3,210,634 shows a bicycle-operated generator in which a belt extends around the rear wheel of the bicycle and around a pulley secured to the armature of a rotary generator. The generator is connected to a battery and the operator may determine when insufficient current is being generated from an ammeter and accordingly increase the pumping and exercise effort.

U.S. Pat. No. 3,240,947 discloses an emergency power system which is manually operated and which includes an improved converter and inverter for rectification of alternating current during conversion of AC power to DC power and which functions during inversion to minimize the generation of high amplitude peak voltages which are normally encountered in such circuits.

U.S. Pat. No. 3,984,666 shows an exercising device having an alternator/rectifier driven by a bicycle wheel. The energy input to the alternator is derived from the exerciser. The output power of the alternator/rectifier is absorbed by a loading resistor. As the individual exercises, the physical work output is converted to electrical power by the alternator/rectifier to be dissipated by the load resistor.

U.S. Pat. No. 4,613,129 shows an attachment which converts a stationary exercise bicycle into an electronic exercise machine. Varying loads are provided by an alternator which can be accurately controlled as to the resistance offered to the pedaling effort of the bicyclist. The alternator is hinged to a floor plate and can be raised about a hinged connection to an operating position in which the bicycle wheel is contacted by a drive wheel for driving the alternator. The load encountered by the rider can be varied as desired by changing the electromagnetic field of the alternator. The alternator output signal provides an indication of speed and amount of energy expended.

U.S. Pat. No. 3,705,721 discloses an exercise device having a regulated electrical generator or alternator driven by an exercise bicycle. The magnitude of load for the generator may be selected by the user through a load circuit.

U.S. Pat. No. 4,595,194 shows a portable and collapsible bicycle training stand or apparatus.

As demonstrated above, there are a number of stationary exercise devices in the prior art which provide variable resistance to the rider and which provide the rider with an indication of speed and amount of energy expended. By and large, these are expensive devices as they are either DC devices or AC devices which require some type of rectification. The other approach found in the prior art is simple mechanical resistance such as ergometer devices which generally utilize a flywheel and some type of friction device. These devices are often bulky and friction resistance devices are subject to mechanical wear and tear. The present device overcomes the disadvantages of many of the prior art mechanical and electrical exercise devices in that the present invention is an AC device which eliminates the requirement for rectification of AC current and which device is effective and is basically self-limiting or controlling as it is an overdrive-type device. The device of the present invention is simple and allows the individual to utilize the individual's own bicycle unlike many ergometer-type exercise bicycles.

Briefly, in accordance with the present invention, the device of the invention has a frame or stand adapted to support a conventional bicycle such as a 10 or 15 speed bicycle. The device has a wheel support which includes opposed strut or shock absorbers which attach at one end to the rear wheel axle of the bicycle and which are pivotally secured at their opposite ends to the frame to permit limited angular tilting or freedom of motion of the bicycle. A roller engages the rear wheel of the bicycle and is driven by the rear wheel and is in driving engagement with the shaft of an AC induction motor through a clutch arrangement. The clutch permits the motor to be driven by the bicycle wheel in only one rotational direction which corresponds to the normal rotational direction of the motor. A watt meter or other power indicating device is connected in the motor circuit. When the rider pedals the bicycle, the roller is driven and when the synchronous speed of the motor is reached, the motor is overdriven and becomes an asynchronous generator which will generate power into the electrical circuit which is reflected on the watt meter. Typically this would occur when the rider reaches a speed which drives the roller at 1800–3600 r.p.m. The watt meter may be calibrated to provide the user a reading of calories expended or some other indication of energy output. The device may also include a cadence counter. The motor circuit may also include an appropriate switch to maintain the motor in an "off" condition until the rider brings the bicycle to synchronous speed.

The above and other objects and advantages of the present invention will become more apparent from the following description, claims and drawings in which:

FIG. 12 is a perspective view of an alternate embodiment of the training apparatus of the stationary type;

FIG. 13 is a sectional view of the training apparatus taken along lines 13—13 of FIG. 12;

FIG. 19 is a perspective view of a thigh strap and attached handle which may be used as an accessory with the training device of the present invention.

Figure 1:
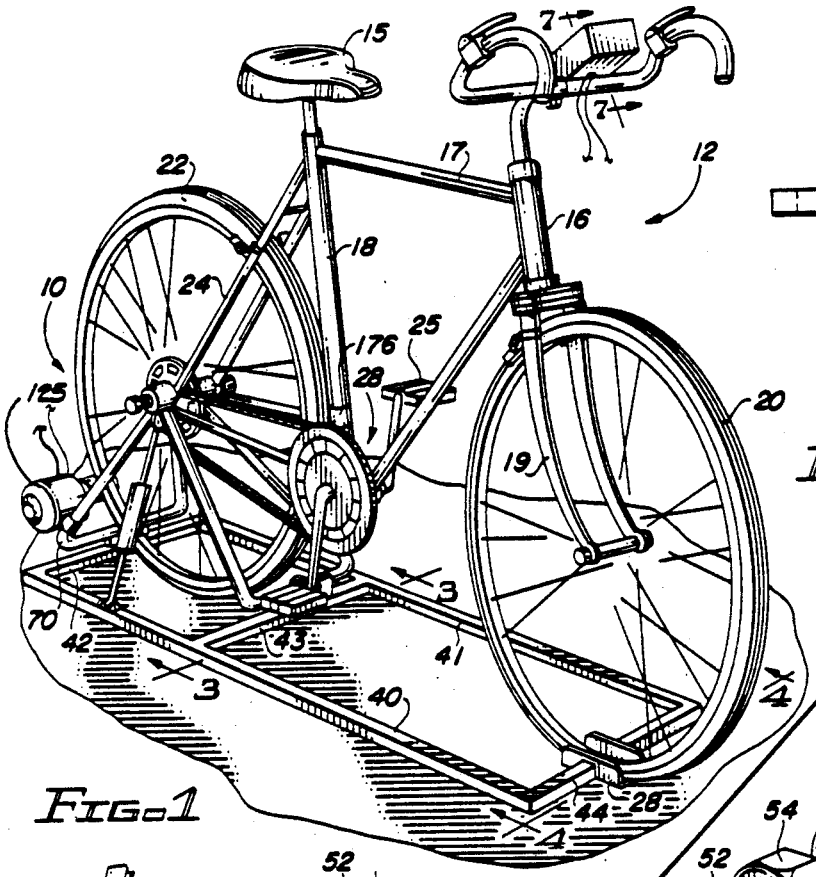
FIG. 1 is a perspective view of the bicycle training apparatus of the present invention with a bicycle positioned upon the apparatus.

Turning now to the drawings, the exercise and training device of the present invention is generally designated by the numeral 10 which supports a bicycle 12 having a frame including a seat 15, tube 16, cross-bar 17 and down tube 18. A fork 19 extends from the front part of the frame which supports a front wheel assembly 20. The rear wheel assembly 22 is rotatively connected to the rear frame member 24 and is driven by a pedal assembly 25 through a drive chain and chain wheel and sprocket assembly 28 as is well known in the art. The description of the bicycle is general and as the bicycle forms no part of the present invention and is set forth only to facilitate an understanding of the present invention which may be used in connection with any conventional style of bicycle.

The training device 10 has a base including a pair of longitudinally extending spaced-apart frame members 40 and 41 which preferably extend a distance at least corresponding to the approximate diameter of the rear wheel and, as shown, may extend a distance corresponding generally to the length of the bicycle. Transverse members 42, 43 and 44 extend between frame members 40 and 41 at rear, intermediate and front locations. The terms "front" and "rear" are used to designate locations in accordance with the orientation of bicycle 12 with the front of the frame, for example, corresponding to the front of the bicycle.

Figure 4:
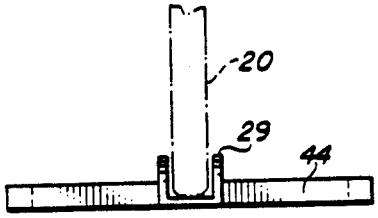
FIG. 4 is a sectional view taken along lines 4—4 of FIG. 1.
Figure 5:
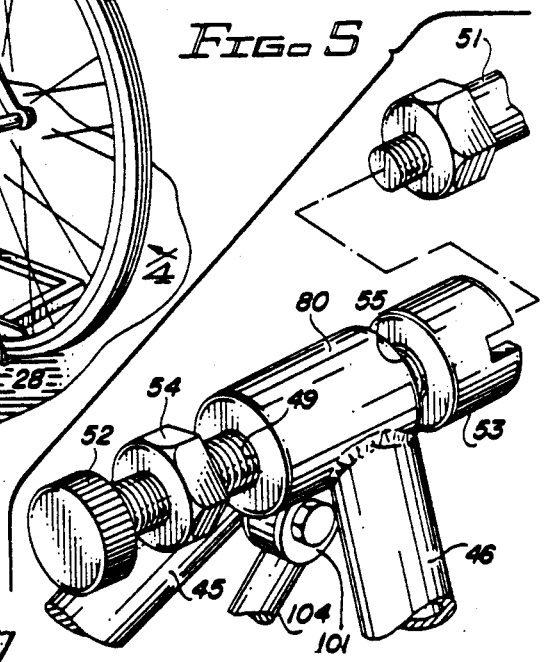
FIG. 5 is a sectional view taken along lines 5—5 of FIG. 2 showing the upper end of the rear wheel support.
Figure 2:
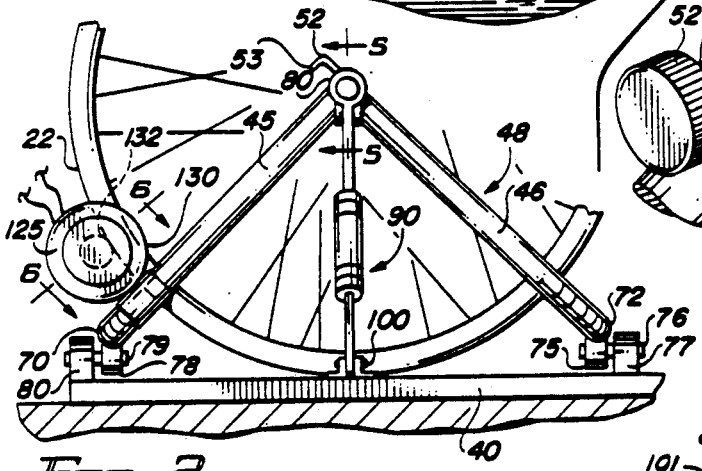
FIG. 2 is a side view of the rear portion of the frame of the training apparatus with a bicycle wheel positioned thereon.
Figure 3:
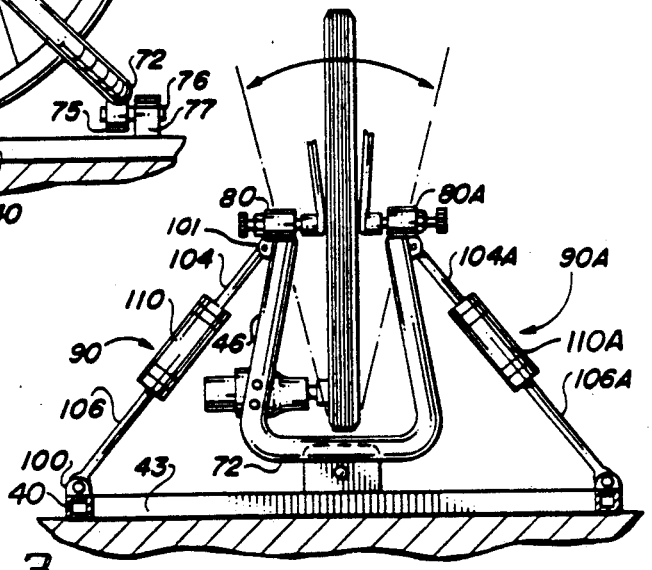
FIG. 3 is a sectional view taken along lines 3—3 of FIG. 1.

The rear bicycle wheel is supported in a pivotally mounted support 48. The support 48 includes a pair of braces 45 and 46 diverging outwardly at either side of the wheel 22 from clamping hub 80 and extending around the wheel converging at the opposed clamping hub 80A as best seen in FIGS. 2 and 3. As best seen in FIG. 5, hubs 80 and 80A each are generally cylindrical defining a threaded bore 49 which receives a clamp screw 55 which has a clamp cone 53 engageable at the opposite ends of the rear axle 51. The clamp screw is axially adjustable at outer knob 52 and when adjusted may be locked at lock nut 54. The front wheel 20 is supported in channel 29 at cross frame member 44, as seen in FIG. 4.

Braces 45 and 46 are each generally U-shaped extending around the periphery of the rear bicycle wheel at bight sections 70 and 72, respectively, and are connected to the right side of the bicycle at hub 80 and to the left side of the bicycle at hub 80A. Bight section 72 of brace 46 is pivotally mounted to cross frame member 43 at bearing 75 which is rotatable on shaft 76 supported by block 77 at a location corresponding to the centerline of the bicycle. Similarly bight section 70 of brace 45 is pivotally mounted to rear cross member 42 at bearing 78 on shaft 79 which is supported by block 80 at a location corresponding to the centerline of the bicycle. It will be apparent that the support 48 is transversely pivotal about a longitudinal axis extending at a location generally corresponding to the lowermost point on the rear tire 22. This allows the rider limited side movement closely approximating the "lean" that occurs when cornering a bicycle, particularly at higher speeds.

The pivotal movement of support 48 is resisted by opposed strut assemblies 90 and 90A. As best seen in FIGS. 2 and 3, strut assembly 90 is pivotally connected at its upper end to hub 80 at clevis 101 and pivotally connected at its lower end to longitudinal frame member 40 at clevis 100. Strut 90 forms an approximate angle of 45° with respect to horizontal. Strut assembly 90 includes oppositely extending rods 104 and 106 which have their inner ends slidable within cylinder 110 which houses a resistance member such as a compression spring. The inner ends of rods 104 and 106 oppositely engage the compression spring. Alternatively, cylinder 110 may be a single acting hydraulic or compressed gas cylinder so that strut assembly 90 will retract and extend to provide predetermined resistance to the limited range of angular side-to-side motion of the bicycle induced by the user.

A similar strut assembly 90A is provided at the right side of the bicycle wheel as viewed in FIG. 3. Assembly 90A includes a cylinder 110A having oppositely extending rods 104A and 106A which pivotally connect to hub 80A and frame member 41, respectively, to provide a predetermined resistance to tilting to the left of the rider. At a predetermined maximum angle of tilt, the strut assemblies will extend and retract to the maximum limiting further tilt. Typically the strut assemblies will limit maximum tilt to about 15° in either direction from vertical as seen in FIG. 3.

It will thus be seen that when the conventional bicycle is placed on the base with the opposite ends of the rear axle 51 engaged and locked in clamping hubs 80 and 80A, the bicycle will be stabilized in a position with the rear wheel slightly elevated so the bicycle may be peddled in stationary fashion with the rear wheel engaging a roller, as will be explained. Further, the support assembly allows some angular side-to-side movement of the bicycle particularly at higher speeds which movement tends to closely simulate the actual motion encountered when riding a bicycle, particularly when cornering.

Figure 6:
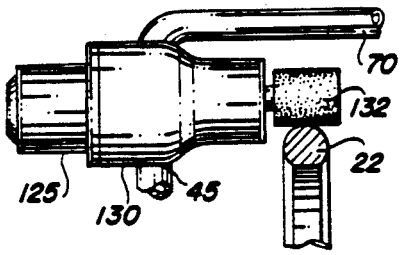
FIG. 6 is a sectional view taken along lines 6—6 of FIG. 2 showing the motor and drive roller.
Figure 8:
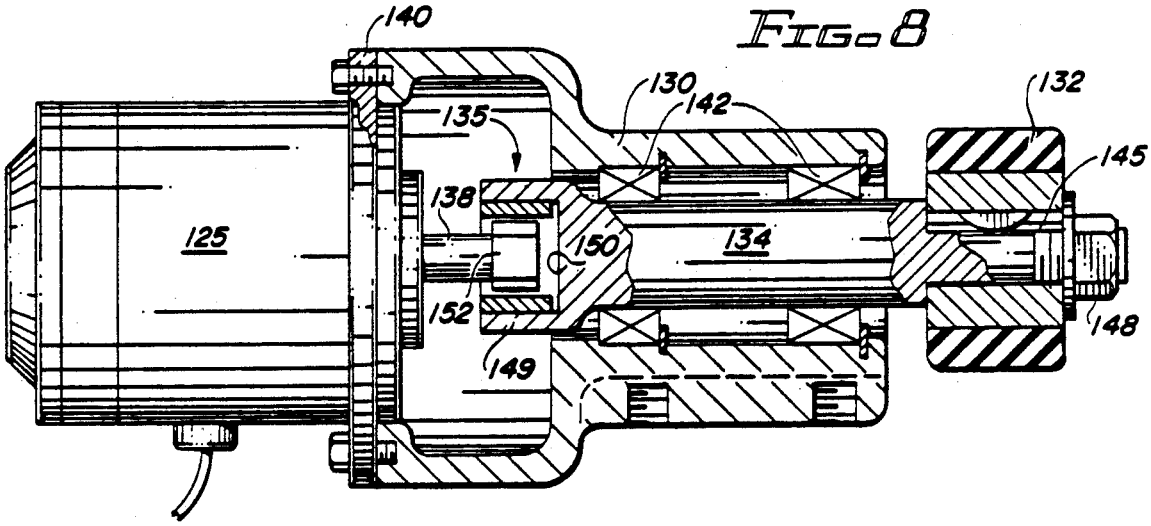
FIG. 8 is a view, partly in section, of the clutch and motor.
Figure 9:
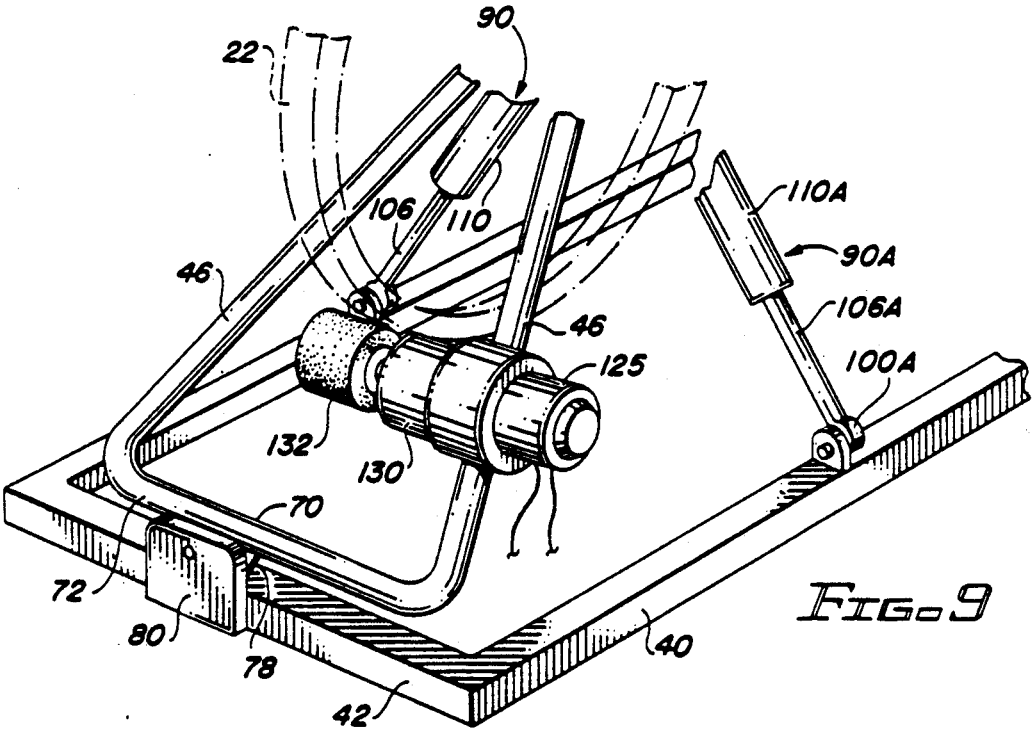
FIG. 9 is a perspective view of a rear portion of the frame and drive.

In order to provide the user with an indication of the energy expended, the device of the present invention is provided with an electrical resistance device. The electrical resistance device includes an AC induction motor 125 which is mounted on support 48 adjacent the rear wheel 22 of the bicycle. AC induction motor may be typically a ⅛ horse power such as the type manufactured by Emerson and designated as Model 2097. As best seen in FIGS. 6 and 8, motor 125 is affixed to clutch housing member 130. Roller 132 is supported on the end of shaft 134 for rotation with the shaft which is mounted in bearings 142 in the clutch housing. Roller 132 engages the rear wheel of the bicycle when the bicycle is in place on the training device and the outer surface of roller 132 is rubber or other material having suitable frictional characteristics. Clutch assembly 135 operates to permit motor 125 to be driven only in one direction of operation by roller 132, as will be explained in greater detail hereafter.

Motor 125 is an AC induction motor and has an output shaft 138 which extends axially within housing 130 with the motor being secured at plate 140 to the housing 130 by bolts or similar fasteners. Transfer shaft 134 is axially mounted within housing 130 in bearings 142. The outer end of transfer shaft 134 defines an axially extending keyway 145 so that roller 132 may be affixed by a key to the shaft allowing the transfer shaft 134 and roller 132 to rotate as a unit. The outer end of shaft 134 is threaded to receive a nut or other fastener 148 to secure roller 132 in position on the end of the shaft.

The inner end of transfer shaft 134 is configured having an enlarged bell section 149 which defines a circular recess, the periphery of which closely corresponds to the outer roller clutch member 150. The outer end of motor shaft 138 is provided with a cylindrical sleeve 152 which engages the rollers of a conventional roller clutch member 150. The operation of the clutch 135 has an overrun mode and a lock mode. The operational mode is controlled by the direction of rotation of shaft 134. Thus, if through rotation of the roller 132 shaft 134 is rotated in a direction opposite the normal running rotational direction of the motor 125, the clutch is free to run and the motor shaft 138 may freely rotate within the clutch and the shaft 134 may rotate about the motor shaft. In the opposite direction of rotation of shaft 134 which would be normally induced by the user pedaling the bicycle in a forward direction, the clutch 135 will engage causing a direct drive relationship to exist from the rotor to the motor.

Various roller clutch assemblies of this type are well known in the prior art and, for example, a Torrington Type RC roller clutch may be used for this purpose. It has been found that the RC-121610 roller clutch may be incorporated in the clutch housing to provide overrun in one direction of rotation and the locking mode in the opposite direction of operation. With the clutch described, in the overrun position, the relative rotation between the housing, clutch and shaft causes a series of circumferential rollers to move away from a locked position against special configured locking ramps in the clutch. The housing and clutch are thus free to overrun in one direction where the shaft is free to turn in the other direction. Accordingly, when the user pedals the bicycle in a normal forward direction driving the wheel clockwise as viewed in FIG. 1, roller 132 will be driven in a counter-clockwise direction causing torque to be transmitted between members 149 and 150 driving the motor shaft in the same direction of rotation as the roller.

If the rotation of the bicycle wheel 22 is driven in the reverse direction by the individual, the roller and connecting shaft 134 will turn freely being disengaged at clutch 135 from motor shaft 138. Further the motor cannot drive the wheel in the reverse direction due to the disengagement of the motor and roller at the clutch.

Figure 7:
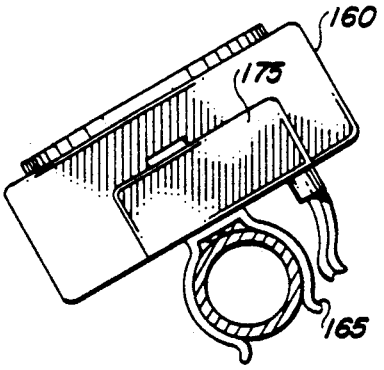
FIG. 7 is a sectional view taken along lines 7—7 of FIG. 1 showing the power indicating device.
Figure 10:
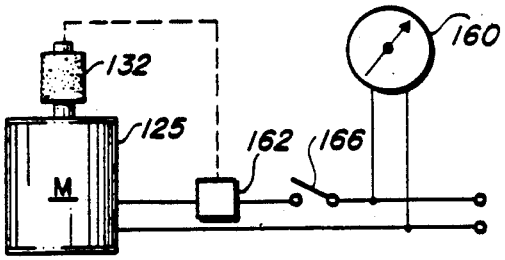
FIG. 10 is an electrical schematic of the motor circuit.

Motor 125 is an induction motor of the AC synchronous type. The clutch permits the motor only to be driven in one direction which direction corresponds to the normal forward pedaling direction of the bicycle. When the rider pedals the bicycle, roller 132 is driven and when the synchronous speed of the motor is reached, the motor is overdriven and the motor becomes an asynchronous generator and begins to generate power into the circuit which is reflected on the watt meter 160. FIG. 10 shows the typical circuit arrangement with the motor connected to a conventional source of AC power. A watt meter 160 or other power measuring device is connected in the circuit and provides a measure of the amount of power generated by the user once synchronous speed is reached. The watt meter or power meter may be calibrated to provide the user a reading of calories expended or some other similar indication of work or energy output and as shown in FIG. 7, the meter 160 is detachably mounted in the handle bars of the bicycle by a clip 165 engageable about the horizontal portion of the handle bars in a position easily viewable by the user.

As shown in FIG. 10, a centrifugal switch 162 may be provided in the electrical circuit so that the motor is not energized until the user reaches a predetermined speed which speed approximately corresponds to the synchronous speed of the motor. Once this speed is reached, the circuit is completed and at the synchronous speed the motor is overdriven becoming a generator with the amount of power generated into the circuit reflected on the meter as an indication of energy expended by the user.

In order for the user to have an indication of energy expended at speeds below the speed at which the motor becomes a synchronous generator, a cadence sensor 176 may be attached to the post 18 of the bicycle to register pedal rotation. Typical cadence counters are available and as for example may be of the type sold under the trademark "Cateye" Model 40-4500, as manufactured by Cateye. The output from the cadence counter can then be read directly by the user on an indicator 175 mounted at meter 160 and may be converted to give an approximate value of energy based on certain measured or assumed values. For example, in order to rotate the bicycle wheel at a certain speed it can be empirically determined that a certain amount of energy is expended. The indicator 175, either a digital or analog read-out, can be calibrated to provide a reading or indication of energy expenditure at various pedal speeds up to the speed at which motor 125 is energized and begins to operate as a synchronous generator at which time the power meter 160 will provide the user with an accurate indication of energy expenditure based on voltage and current generation.

Figure 11:
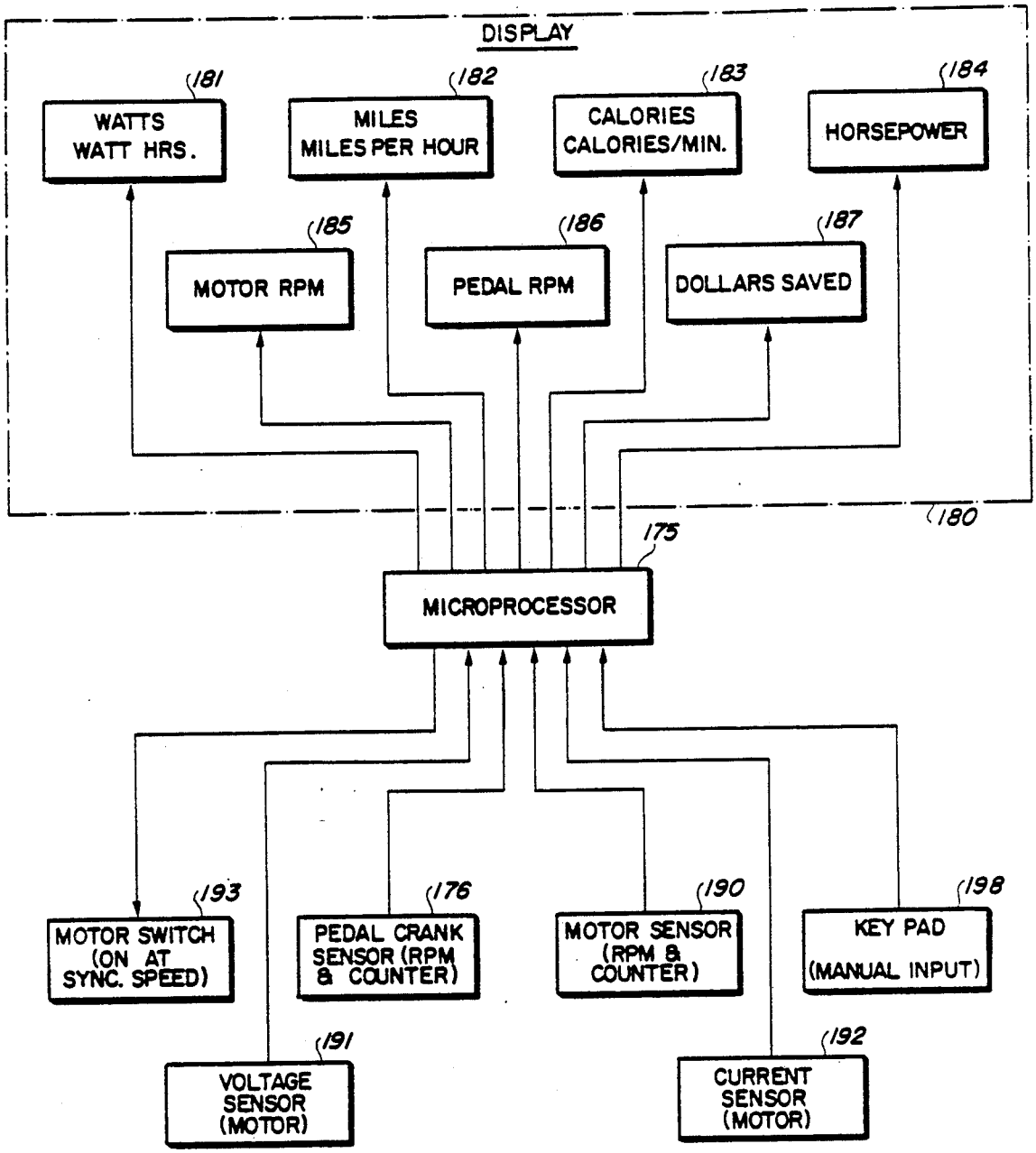
FIG. 11 is a schematic of a microprocessor based monitoring and display system that may be incorporated as part of the device of the present invention.
Figure 14:
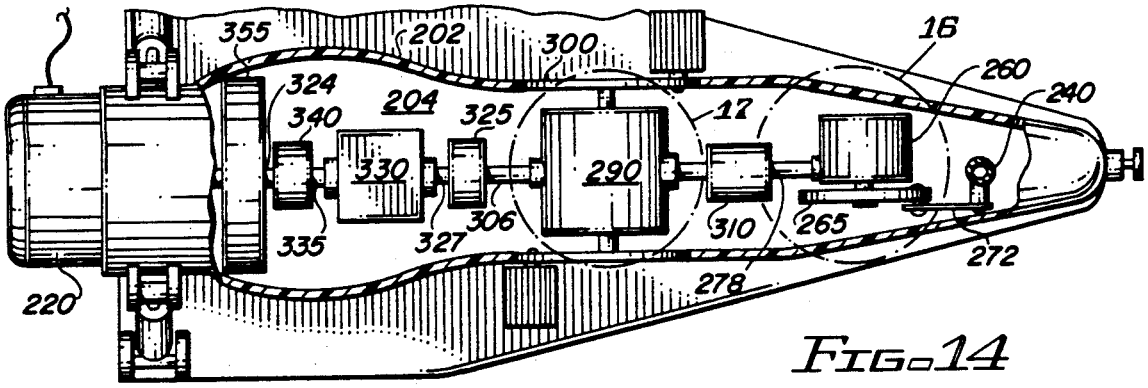
FIG. 14 is a sectional view of the training apparatus taken along lines 14—14 of FIG. 12.

The present invention also lends itself to the addition of more sophisticated monitoring systems. FIG. 11 shows such a system. Here the indicator 180 viewable by the user will indicate or display watts at 181, miles per hour at 182, calories expended at 183, horsepower at 184, motor rpm at 185 and pedal rpm at 186. Display 187 indicates energy savings realized by the generation of power into the electrical grid system.

Pedal crank sensor 176 inputs to microprocessor 175. Similarly, sensors 190, 191 and 192 monitor motor rpm's, motor voltage and motor current and the output from these sensors are provided as inputs to microprocessor 175. Switch 193 serves to activate the motor only at a predetermined speed as for example the synchronous speed of the motor. Manual input to change displays or to program the unit is by means of key pad 198.

A typical display and the required inputs are as follows:

| Display Capabilities | |
|---|---|
| Stop Watch | (* - Motor not Required On) |
| Output Desired: | |
| Instantaneous | Digits |
| 1. Watts | 0.00 |
| *2. Speed MPH | 00.0 |
| *3. Calories/Min. | 000 |
| *4. Motor RPM | 0000 |
| 5. Horsepower | 0.0 |
| *6. Pedal RPM | 000.0 |
| Accumulating Resetable | |
| 1. Watt - HR | 000.0 |
| *2. Distance - Miles | 000.0 |
| *3. Calories | 0000 |
| 4. Money Saved | $0.00 |
| Totalizing Non-Reset | |
| *1. Distance/Miles | 00000 |
| 2. Payback | Paidback 0 Times |
| Inputs Required: | |
| Fixed Assumption | |
| 1. Watts vs. Calories | Conversion |
| 2. Bicycle Efficiency | |
| 3. Generator Efficiency | |
| Fixed Elect or Mech. | |
| *1. Motor Speed RPM & Accumulating Counter | |
| 2. Voltage | |
| 3. Amperage | |
| Operator Input | |
| 1. Elect. Cost Avg. cents per KWH | |
| A. Last Mo. Bill Amt. | |
| B. Last Mo. Bill KWH | |

Turning now to FIGS. 12 through 18, an alternative embodiment of the training device of the present invention is shown which is generally designated by the numeral 200. The exercise and training device previously described is primarily adapted for use with a conventional bicycle. The training device of the present embodiment is a dedicated stationary exercise and training device which incorporates a number of the novel features described with reference to the previous embodiment.

Figure 18:
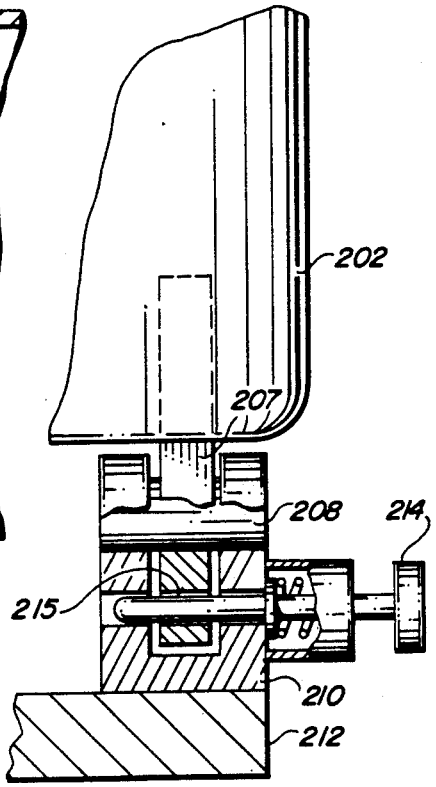
FIG. 18 is a detail view of the frame locking mechanism as indicated in FIG. 13.

Stationary training device 200 includes a generally elongate housing 202 which defines a suitable enclosure 204 which contains a number of the components of the device. These components may be mounted on a longitudinally extending, open frame but for aesthetic and safety considerations, are preferably contained within housing 202. Axially extending support shaft 208 is mounted on plate 207 at the forward end of the housing and extends through U-shaped journal member 210 which is supported by a surface engaging platform 212. The support arrangement permits the exercise device limited side-to-side pivotal movement about shaft 208. As best seen in FIG. 18, a locking pin 214 is axially slidable relative to journal member 210 and may be selectively engaged in aperture 215 in plate 207 to stabilize the device in the event the user does not wish pivotal movement be imparted to the device during exercise use. The side-to-side pivotal movement approximates the lean that occurs when a bicycle corners, particularly at higher speed. If pivotal motion is desired, pin 214 is withdrawn from aperture 215 and rotated to lock the pin in a disengaged position.

Opposed strut or shock absorbers 284 extend between the rear of the housing 202 and platform 212. The side-to-side pivotal movement of the device is resisted by the opposed strut assemblies. Strut assemblies 284 include rods 286 which have their inner ends slidable within a cylinder 285 which includes a resistance member such as a compression spring. The outer ends of the rods 286 are attached to housing 220 at clevis connection 289. In the alternative, the cylinders may be single action, hydraulic or compressed gas cylinders. If the pivotal side-to-side motion is not desired, locking pin 214 may be engaged at the front support restraining the housing against side-to-side movement. The distal ends of the rods and cylinders are pivotally received at clevis supports 287.

An electrical device 220 is positioned at the rear of the housing 202 preferably axially aligned therewith. Device 220 is connectable by a power cord 222 to a suitable source of AC power. The electrical device is preferably an AC induction motor of the synchronous type as described above. Preferably, the power circuit incorporates a sensor or switching mechanism which causes the motor to remain unenergized below a predetermined speed, generally approximating synchronous speed. Only when a predetermined input speed is imparted to the input shaft 224 is the device connected in the power circuit. When a predetermined input speed is reached, the device generates electricity rather than utilizing electricity. At lower speeds, the device 220 does not utilize power since it is isolated from the power circuit.

A pedestal 230 extends vertically from the housing at an intermediate location and telescopically receives seat post 232. Seat 235 is mounted on the upper end of the post and the position of seat 235 may be vertically adjusted at clamp 236.

A crank arm 240 extends vertically at the forward end of the housing having oppositely extending handle bars 242 near the upper end of the crank arm. The handle bars 242 are shown as the drop type having grips 245 to enable the user to comfortably hold the handle bars. The arm 240 is shown having a vertical extension 241 providing a single, central grip for the user. Crank arm 240 is longitudinally pivotal about transversely extending pivot pin 248 secured to bracket 249 which is a stationary part of the housing. A flexible boot 250 extends from the crank arm to the housing enclosing these components.

A secondary transmission 260 is provided at the forward end of the housing and is shown in detail in FIG.

Figure 15:
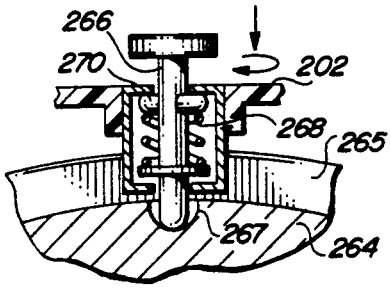
FIG. 15 is a detail view of the locking pin for locking the hand-operated pivot arm and flywheel mechanism as indicated in FIG. 13.
Figure 16:
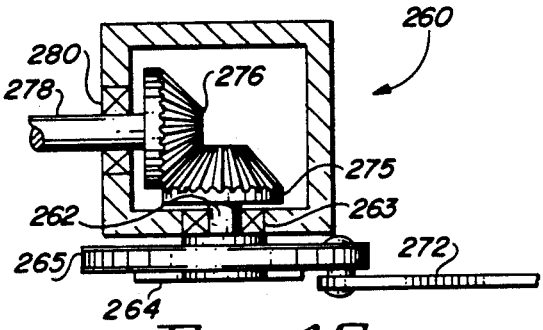
FIG. 16 is a detail view of the flywheel and transmission as indicated in FIG. 14.
Figure 17:
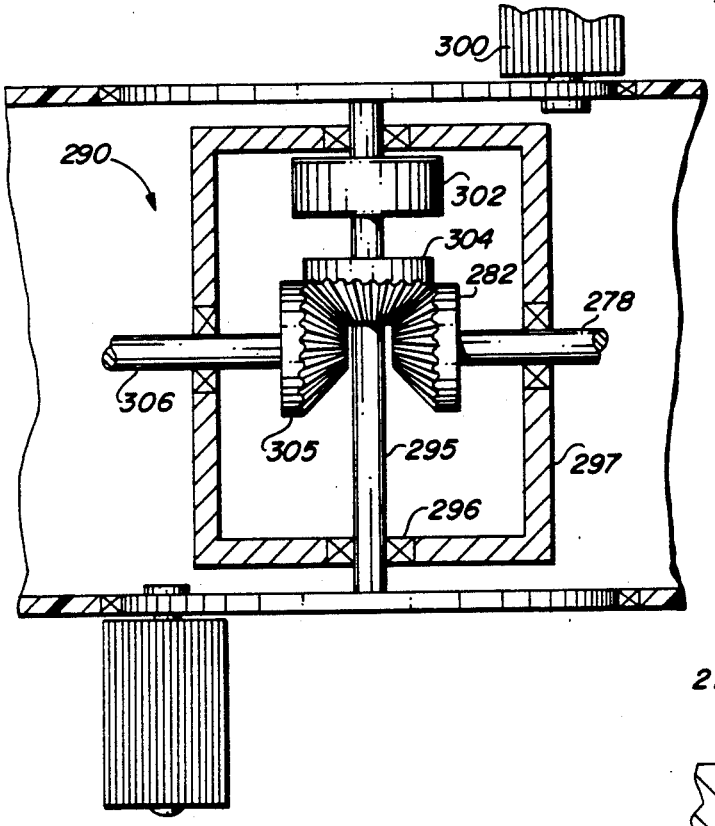
FIG. 17 is a detail view of the primary transmission as indicated in FIG. 14.

16. The secondary transmission includes a transversely extending stub shaft 262 mounted in bearings 263. Hub 264 of circular flywheel 265 is mounted at one end of shaft 262. As seen in FIG. 15, hub 264 is selectively engageable with manually operable locking pin 266 which registers with bore 267. Pin 266 extends exteriorly of housing 202 at a convenient location for manual operation by the user. Pin 266 is biased downwardly by spring 268 and may be engaged in a non-locking position by rotating the pin to a position allowing projection 270 to be withdrawn and thereafter rotating the pin to a position with projection 270 engaging the outer surface of the enclosure 202.

Flywheel 265 is connected to the lower end of crank-arm 240 by link 272 connected to the lower end of arm 240 and to a peripheral location on the flywheel at suitable pivot connections. When pin 266 is disengaged, motion imparted to arm 240 will, through link 272, impart rotational motion to flywheel 265 and shaft 262. When pin 266 is in a locked position, arm 240 is restrained in a stationary position.

The inner end of stub shaft 262 carries a bevel gear 275 which engages bevel gear 276. Bevel gear 276 is carried on axially extending shaft 278 suitably mounted in bearings 280.

The opposite end of shaft 278 terminates at gear 282 at primary transmission 290. Transmission 290 is located at an intermediate location below seat 235 and includes transversely extending axle 295 suitably mounted in bearings 296 in housing 297. The opposed ends of shaft 295 each carry a crank and pedal mechanism 300 through which the user rotates shaft 295. Shaft 295 carries unidirectional clutch 302 which may be a roller type clutch as previously described. Clutch 302 is operatively connected to bevel gear 304 which engages bevel gear 282 at the distal end of the forward driven shaft. With this arrangement, clutch 302 permits bevel gear 304 to be driven in only one direction of operation. In the other direction of pedal operation, which would be considered backward pedal operation, clutch 302 will overrun and no motion will be imparted to the bevel gear 304 and to engaging gear 305 and primary drive shaft 306. Similarly, rotation of shaft 295 will not drive the pedal and crank mechanism.

A one-way clutch 310 is interposed on shaft 278 so bevel gear 282 is driven only in one rotational direction through manual operation of crank arm 240 and operation of the crank assembly 300 will not drive the arm 240.

The main drive shaft 306 which extends rearwardly from primary transmission 290 and is connected to unidirectional clutch 325. The opposite side of clutch 325 is connected by shaft 327 to in-line speed increaser 330. Preferably the in-line speed increaser has a speed ratio of approximately 18 to 1 so that a pedal cadence of approximately 60 rpm will drive the output shaft 335 of the increaser at approximately 1200 rpm or more. Shaft 335 connects the speed increaser to coupling 340. The opposite side of coupling 340 is connected to the input shaft 224. Preferably a large flywheel 355 is interposed between coupling 340 and the device 220 on shaft 224 to smooth out operation of the drive components.

Electrical device 220 as previously described, is preferably an AC induction motor of the type manufacured by Emerson and designated Model 2097. Clutch 325 permits the device 220 to be driven in only one direction of operation which direction corresponds to the normal forward pedaling direction. The power circuit includes an appropriate switch as shown in FIG. 10 which prevents the motor from being energized until the user reaches a predetermined pedal speed which approximately corresponds to the synchronous speed of the electrical device.

In order for the user to have an indication of the energy expended, a cadence sensor may be connected to the crank shaft 295 to provide the user a reading or indication of speed up to the speed at which the device 220 is energized and begins to operate as a synchronous generator. A power meter such as has been described previously may be incorporated which will provide the user with an accurate indication of energy expended based on voltage and current generation. These features have been described in detail with reference to FIG. 11 and further detailed discussion is not believed necessary.

In use, the individual mounts the device positioned in a comfortable position on seat 235 with feet in position on the opposite crank pedals. Height adjustment of the seat is accomplished at adjustment clamp 236. The user determines whether the user wishes to impart a side-to-side pivotal movement as the exercise program proceeds. If so, lock pin 214 is disengaged. The user will also determine whether or not the user wishes to engage in upper body exercise at the same time the bicycling motion is being applied. If so, locking pin 266 is raised to a disengaged position with respect to the flywheel 265. The exercise program is initiated with the user pedaling the pedal crank 300 and at the same time exercising the arms and upper body by imparting a longitudinal pivotal movement to the crank arm 240 through the handle bar 240. These energy inputs are totalized at primary transmission 290 and utilized to drive shaft 306 which rotational shaft speed is increased at speed increaser 330. The output from in-line speed increaser 330 is applied to flywheel 355 and electrical device 220. Below synchronous motor speed, device 220 remains de-energized with the user working against the mechanical resistance of the components. Once synchronous speed is reached, the sensor in the power circuit will apply electrical energy to device 220 causing it to operate as a synchronous generator at which time the power meter will provide the user with an accurate indication of energy expenditure based on voltage and current generation due to the exercise and energy expenditure of the individual. Other displays such as those shown and described with respect to FIG. 11 may be incorporated.

Clutch 302 serves to prevent the pedal crank shaft 295 from being driven by rotation of the drive shaft 306. Clutch 310 prevents the pedal crank from driving the handle bars and clutch 325 prevents the motor from driving the pedal crank and the handle bars. The exercise program may be limited to use of the lower body and legs by locking the handle arm 240 at locking pin 266. Similarly, side-to-side lean or pivot may be discontinued by locking the housing in a stationary position at locking pin 214.

In certain exercise situations, the user may wish to assume a more upright position and either let the pedaling motion of the legs exercise arms and the portion of the upper body or user may wish to apply additional force to the legs through the arms and upper body. To accomodate this type of exercise, accessory device as shown in FIG. 19 may be used. This device is generally designated by the numeral 400 and includes a strap 410 having opposite ends 412 and 414. The inner face of end 414 is provided with one component 416 of a loop and pile fastener such as that sold under the trademark Velcro. The opposite end of the strap 412 is provided on its outer surface with the other component 418 of the loop and hook fastener. Strap 410 may be fabricated from any suitable material such as leather, plastic or a suitable fabric. A handle 425 is attached to the strap. In most exercise situations, two such accessory devices 400 would be provided. The user would attach one about each thigh with the handle 425 extending in an upward position to be grasped by the hands of the user. Thus, in the exercise program, the user can either let the arms follow the motion of the legs imparting an exercise motion to the arms or, alternatively, the user may impart additional energy to the legs through the arms at the accessory device.

From the foregoing it will be obvious to those skilled in the art that various changes, alterations and modifications may be made to the physical training device of the present invention. To the extent such changes, alterations and modifications do not depart from the spirit and scope of the appended claims, they are intended to be encompassed therein.

We claim:

1. A user-operated exercise device comprising:

(a) a base member;

(b) a pedal-operated crank operatively connected to drive a shaft at a first power transmission means;

(c) an AC induction electrical device having an input shaft, said electrical device connectable in a power circuit and being operable as an asynchronous generator upon reaching a predetermined speed;

(d) first uni-directional clutch means operatively interposed between the input shaft of said electrical device and the said drive shaft whereby said input shaft is driven in only one rotational direction by operation of said pedal-operated crank;

(e) seat means for supporting the user; and (f) arm means on said base, said arm means having handle means adapted to be grasped by the user, said arm means being pivotally secured to said base member and being connected through second power transmission means to said drive shaft to enable the user to pivotally operate said arm means to drive the drive shaft.

2. The device of claim 1 further including control means in said power circuit operative to energize said electrical device only when a predetermined crank speed is achieved by the user.

3. The device of claim 1 wherein said base member is pivotally mounted on a support member permitting pivotal movement of the base member about a longitudinal axis.

4. The device of claim 1 further including energy absorbing strut means extending between said base member and said support member to resist the pivotal movement of said base.

5. The device of claim 4 wherein said base member comprises an enclosure housing said drive shaft, electrical device and clutch means.

6. The device of claim 1 wherein second clutch means are interposed between said second power transmission means and said drive shaft to prevent operation of the crank from driving the arm means.

7. The device of claim 1 wherein said second power transmission means includes a rotatable flywheel connected to said arm means by a link imparting rotation to the flywheel as the arm means is operated by the user.

8. The device of claim 1 including locking means for selectively locking said arm means in a fixed position.

9. The device of claim 1 wherein said first power transmission means includes bevel gears connecting said crank to said drive shaft.

10. The device of claim 9 further including third clutch means interposed between said crank and said bevel gears to prevent the crank from being driven by rotation of said bevel gears.

11. The device of claim 1 further including indicator means connectable to said power circuit to provide an indication to the user of the power generated by said electrical device upon said electrical device reaching synchronous speed as an indication of the work expended by the user.

12. A user-operated exercise device comprising:

(a) a generally longitudinally extending housing (b) a pedal-operated crank connected to a first power transmission through a first clutch to operatively drive a drive shaft in one rotational direction;

(c) an AC induction electrical device having an input shaft, said electrical device connectable in a power circuit and operable as an asynchronous generator upon being driven at said input shaft at a predetermined speed;

(d) a second clutch interposed between said drive shaft and said electrical device to prevent the electrical device from driving the crank;

(e) speed increasing means interposed between said drive shaft and input shaft wherein said input shaft is driven unidirectionally at a speed greater than said drive shaft;

(f) a seat for supporting the user in a position to operate the crank;

(g) arm means pivotally connected to said housing having handle means for the user to grasp to pivot said arm means in a longitudinal direction;

(h) second transmission means connected to said arm means and having a second output shaft connected to said first tranmission; and (i) a third clutch interposed between said second output shaft and said first transmission means to prevent the crank from driving the arm means.

* * * * *